United States Patent [19]

Billings et al.

[11] 4,194,965

[45] Mar. 25, 1980

[54] FLUID CATALYTIC CRACKING

[75] Inventors: Ronald P. Billings, Clementon; Ellen M. Hysell, West Deptford, both of N.J.

[73] Assignee: Mobil Oil Corporation, New York, N.Y.

[21] Appl. No.: 874,441

[22] Filed: Feb. 2, 1978

[51] Int. Cl.[2] ..... C10G 11/04; B01D 15/06; B01J 23/64

[52] U.S. Cl. ..... 208/113; 252/417; 208/DIG. 1; 208/120; 208/121; 208/164

[58] Field of Search ..... 208/113, 120, 164, DIG. 1; 252/417

[56] References Cited

U.S. PATENT DOCUMENTS

| | | | |
|---|---|---|---|
| 3,909,392 | 9/1975 | Horecky et al. | 208/120 |
| 4,043,899 | 8/1977 | Anderson et al. | 208/161 |
| 4,064,037 | 12/1977 | Graven et al. | 208/120 |
| 4,064,038 | 12/1977 | Vermilion et al. | 208/120 |
| 4,064,039 | 12/1977 | Penick | 208/160 |
| 4,072,600 | 2/1978 | Schwartz | 208/120 |
| 4,092,722 | 5/1978 | Hofferber et al. | 208/164 X |
| 4,093,535 | 6/1978 | Schwartz | 208/120 |
| 4,093,537 | 6/1978 | Gross et al. | 208/164 |

FOREIGN PATENT DOCUMENTS

| | | | |
|---|---|---|---|
| 1481563 | 8/1977 | United Kingdom | 208/120 |

*Primary Examiner*—O. R. Vertiz
*Assistant Examiner*—G. E. Schmitkons
*Attorney, Agent, or Firm*—Charles A. Huggett; Michael G. Gilman

[57] ABSTRACT

In Fluidized Catalytic Cracking (FCC), the significant advantages of stripper cyclones in the reactor are enhanced by operating the regenerator in CO combustion mode.

4 Claims, 2 Drawing Figures

FLUID CATALYTIC CRACKING

FIELD OF THE INVENTION

The invention is concerned with improvement in operation of plants for practice of Fluidized Catalytic Cracking (FCC), and is more particularly directed to optimum utilization in such plants of stripper cyclones in FCC reactors. In designing new FCC plants so equipped with stripper cyclones, the heat balanced unit can be adjusted to effects of such cyclones with or without applying the present invention. In existing plants designed for satisfactory heat balance when burning in the regenerator of hydrocarbons which can be removed by stripper cyclones; constraints inherent in the plant design can limit the advantages available from stripper cyclones. However, in all cases, the advantages of stripper cyclones are maximized by operating the regenerator in a complete CO combustion mode.

BACKGROUND OF THE INVENTION

The FCC Process has been a major petroleum refinery unit facility for about forty years in the capacity of converting petroleum fractions heavier than gasoline, boiling above about 400° F., into high octane naphtha suitable for blending as a major stock in the manufacture of motor gasoline. Typically, preheated petroleum fractions in the nature of gas oils and heavier (boiling ranges above about 550° F.) are contacted with hot cracking catalyst of a size suited to fluidization, say 200 mesh, under conditions to suspend or fluidize the powdered catalyst in vapor of the charge. Conversion of the charge takes place at the contact temperature in excess of 850° F., usually 950° F. or higher, up to about 1000° F. In general, the major product sought in naphtha suitable for use in motor gasoline having a boiling range upwards of about 100° F. to 375°–425° F. This is accomplished by cracking of the charge components to lower boiling compounds in the motor fuel range.

The cracking reaction is accompanied by a number of other reactions such as polymerization, hydrogen exchange, isomerization and the like. In addition, primary products of cracking are susceptible to further cracking and other reactions. The net result of this complex of reaction paths is endothermic overall, that is, the cracking conversion consumes heat in an adiabatic system resulting in a drop in temperature of the mass of reactants and catalyst. The heat required to bring the mass to reaction temperature and to satisfy the endothermic heat of reaction is derived solely from sensible heat of the charge stock and catalyst. Since it is undesirable that the charge undergo thermal cracking which yields much lower octane number naphthas, preheat of the charge is generally limited to about 700° F. or lower, leaving the major burden of heat supply to be borne by the catalyst.

Among the reaction products in addition the desired naphtha are gas oils, kerosenes, light hydrocarbons of one to four carbon atoms and a carbonaceous deposit on the catalyst surfaces (commonly called "coke") which masks the active sites of the catalyst surfaces and renders the same inactive because unable to make contact with the molecules of the charge and induce reaction. The coke is removed by burning in air to regenerate activity of the catalyst in a vessel to which the inactivated (spent) catalyst is transferred from the reactor. The catalyst is heated by the burning of coke, thus reaching an elevated temperature at which it is returned to the reactor for supply of heat to bring charge to reaction temperature and to supply endothermic heat of reaction.

Modern FCC units operate in a heat balanced mode in which the amount of catalyst returned to the contact with charge in the reactor is automatically controlled to maintain a desired reaction temperature. Thus an increase in regenerator temperature automatically results in reduced catalyst flow from regenerator to reactor as the instruments detect a tendency for increased reactor temperature. Thereby an important reaction parameter is necessarily affected by the reduction in catalystto-oil ratio (cat to oil or C/O) which corresponds generally to the space velocity parameter of fixed bed catalysis. The reduction in C/O reduces severity of the conversion, as increased space velocity reduces severity in fixed bed reactors. This absolute interdependence of variables is a major characteristic of FCC commercial units and has great significance in operation according to this invention.

The advent of zeolite cracking catalysts in the early 1960's resulted in an important shift in the nature of catalytic cracking in general and FCC in particular. See, for example, U.S. Pat. No. 3,140,249. These cracking catalysts yield significantly less coke and dry gas than do the older catalysts of amorphous silica-alumina at the same level of conversion and are much more active in that they induce a higher level of conversion measured as yield of products outside the boiling range of the charge at the same conditions of reaction. It will be seen that the zeolite catalysts provide less "fuel" to be burned in the regenerator for supply of heat required by the reactor.

The course of reaction in the regenerator involves oxidation of the coke, with the small amount of hydrogen in the coke being converted to water. The primary reaction products of oxidizing carbon are carbon monoxide and carbon dioxide. The latter represents complete oxidation of carbon, extracting the fullest measure of heat generation from the fuel. The carbon monoxide content of the gases derived from regeneration constitutes a potential fuel and is regarded as a contaminant if present in the flue gases discharged to the atmosphere. It has been conventional practice to pass the flue gases from FCC regenerators to boilers for combustion of carbon monoxide and recovery as steam of the heat energy derived from that combustion as well as that available from ensible heat of the flue gas. Such "CO boilers" must maintain a temperature high enough to promote combustion of CO, about 1500° F. To maintain that temperature, it is customary to supply supplemental fuel (gas or heavy liquid) to the CO boiler together with the quantity of air required for combustion of CO and supplemental fuel.

As is well known in this art, there is a tendency for burning of carbon monoxide in the FCC regenerator, a type of operation which has, in the past, been a source of problems and has been suppressed by limiting the air supply to the regenerator with consequent damping of the coke burning and by injection of water or steam to the space above the dense fluedized bed in the regenerator in order to quench burning of carbon monoxide. As the gases from combustion of coke rise from the dense fluidized bed in which burning regeneration is conducted, they enter a spaced above the dense bed. The gases so disengaged from the dense bed carry with them a small amount of entrained catalyst and constitute a "disperse phase" of minor amounts of catalyst in a rising mass of gas which contains carbon dioxide, carbon monoxide and unconsumed oxygen as well as water vapor, nitrogen, etc. This combustible mixture can and does undergo partial reaction of carbon monoxide and oxygen with release of large amounts of heat in the disperse phase. Since the amount of catalyst in this disperse phase is small, the heat is diverted to heating of the flue gas and temperature of that mass rises rapidly. The adverse effects of excessive temperatures at this stage by irreversible deactivation of catalyst and damage to regenerator internals by exceeding metallurgical limits are so great that extensive and ingenious expedients have been considered as control means. The most widely adopted until quite recent times has been introduction of quench media, water, steam, etc., to the disperse phase or within such regenerator internals as cyclone separators, plenum and the like.

More recently, developments have been made which permit burning of CO in the regenerator by constraining that burning to a region of relatively high catalyst density such that the heat of CO combustion is largely absorbed in heating of particles of solid catalyst. One of those techniques manages to cause catalytic burning of CO in the dense bed where catalyst density is high under conventional conditions of operation. Another technique permits conventional thermal burning of CO in the disperse phase and injects thereto large amounts of catalyst to increase catalyst density of the disperse phase greatly above that encountered in conventional operation. The first mentioned technique of moving the combustion reaction to a region of conventionally high catalyst density is described in British Pat. No. 1,481,563 published Aug. 3, 1977. The other technique of moving catalyst to a region of conventional CO combustion is described in U.S. Pat. No. 3,909,392, dated Sept. 30, 1975. The full disclosure of both cited patents on CO combustion are hereby incorporated herein by this reference.

By any technique of burning CO in the regenerator in the presence of large amounts of catalyst, it becomes possible to raise the temperature of regeneration thus raising the rate of coke burning to provide regenerated catalyst of lower residual coke content and hence more active. These techniques also permit recovery of a greater proportion of the fuel value of the coke within the FCC cycle of reactor and regenerator for direct use in heat balancing the unit. As would be expected, the CO burning techniques require increased supply of air to assure an excess of oxygen for complete or partial combustion of CO as desired. In general, these techniques result in higher temperature of regenerated catalyst and necessarily cause reduction of the cat/oil ratio, well compensated by the higher activity of the cleaner (less coke on regenerated catalyst) catalyst so produced.

A further important advance in FCC technology is the so-called "riser reactor" in which hot catalyst and charge stock are supplied to the lower end of a vertical tubular reactor discharging at its upper end into primary cyclones which separate most of the catalyst from the reacted hydrocarbon vapors. Those vaporous reaction products then discharge into an enlarged zone before passing through secondary cyclone separators for removal of minor amounts of catalyst which remain suspended in the vapor products. Ideally, the conversion should terminate immediately at the top of the riser in order that there shall be no further conversion of the desired naphtha product to light gases. The disengaged catalyst contains, in addition to the non-volatile coke, a significant amount of volatilizable hydrocarbons which can become product if recovered, but constitute further fuel load on the regenerator if not removed from the spent catalyst. It is customary to pass disengaged catalyst, including that separated in the cyclones through a stripping zone in which it passes in counter-current contact with steam to volatilize hydrocarbons and strip them from the catalyst. Stripping steam with stripped hydrocarbons pass from the reactor with the disengaged vapor product to fractionation and recovery of the several products of the reaction. As would be expected, the adsorbed hydrocarbons, including naphtha components are subject to further conversion until finally removed by action of the stripping steam.

A recent development in catalytic cracking is the "stripper cyclone" for riser reactors as described in U.S. Pat. No. 4,043,899, dated Aug. 30, 1977, the entire disclosure of which is incorporated herein by this reference. Using the stripper cyclone technique, the suspension of catalyst in reaction product vapor is discharged from a riser into a cyclone having a spiral steam stripper section integral therewith. By this technique volatile hydrocarbons are removed from contact with the catalyst promptly after leaving the riser. This is shown to provide greater selectivity for gasoline at the same conversion level since naphtha components are subject to a lower possibility of further conversion.

SUMMARY OF THE INVENTION

It has now been found that a particular combination of certain of the known practices described above result in unexpected overall improvement of FCC operation as measured by total conversion of the charge stock and selectivity for desired product as measured by proportion of the conversion products constituted by gasoline. The invention contemplates a riser reactor and stripper cyclone combination associated with a regenerator operating in the CO combustion mode.

BRIEF DESCRIPTION OF DRAWINGS

Equipment for practice of the invention is illustrated by the annexed drawings wherein:

FIG. I is a diagrammatic sketch in elevation of the stripper cyclone; and

Figure 1:
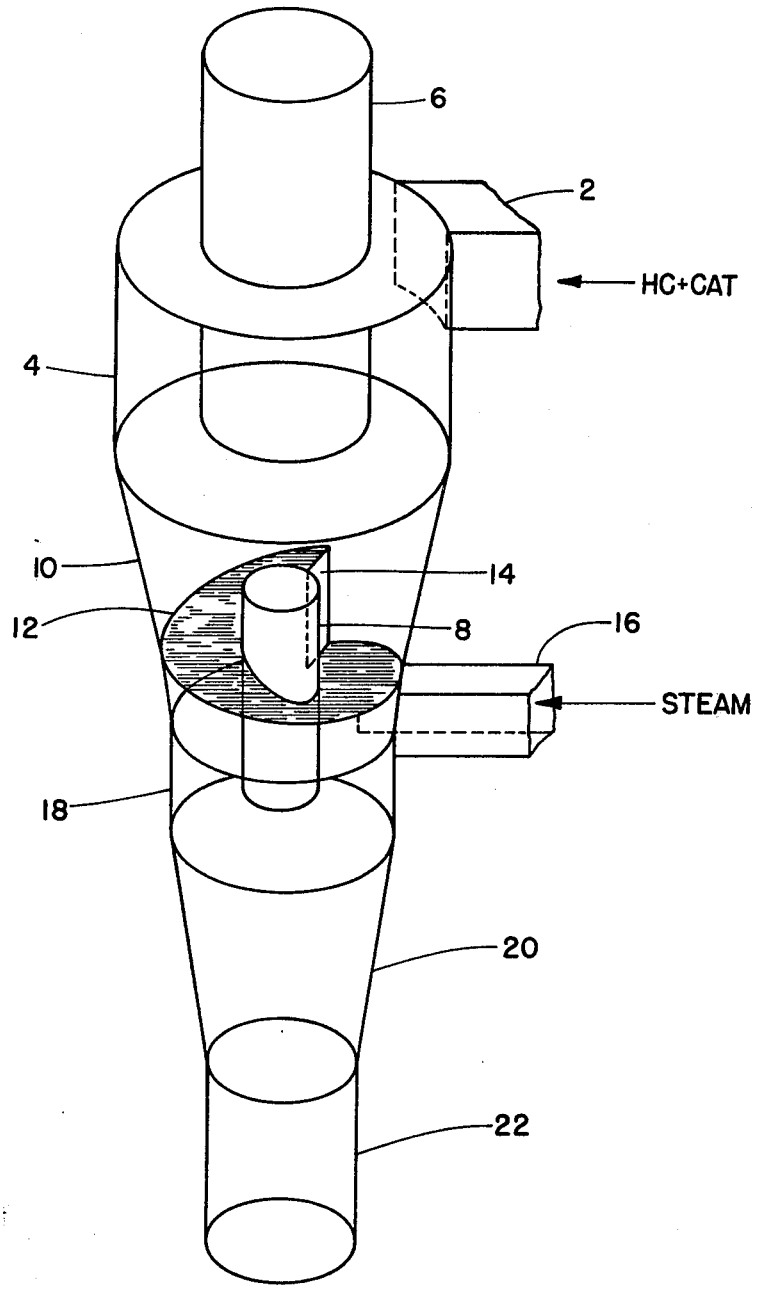
Figure 2:
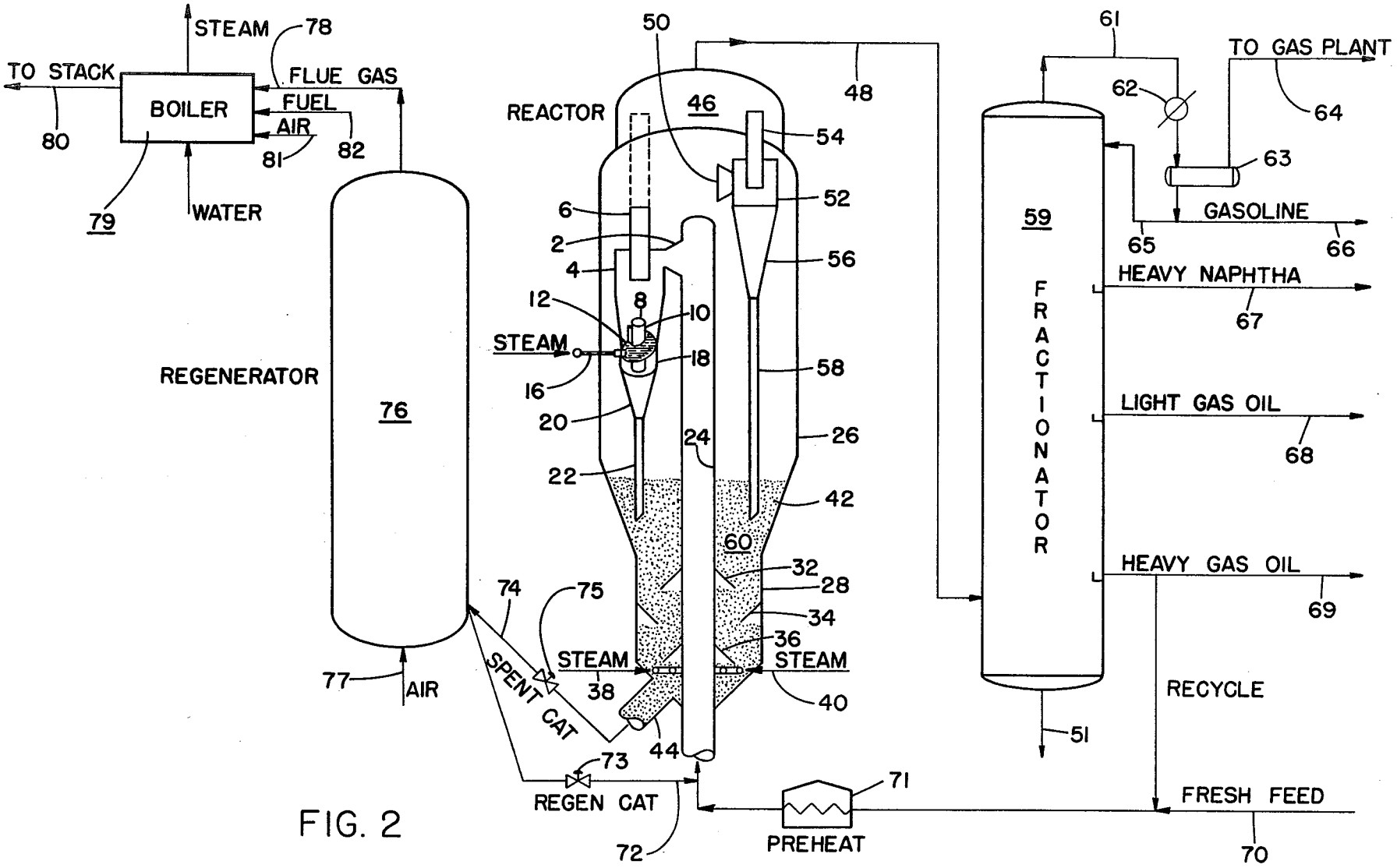

FIG. II represents the relation in generally flowsheet form of an FCC unit and major auxiliaries suited to operation in accordance with the invention.

DISCUSSION OF SPECIFIC EMBODIMENTS

Referring now to FIG. I of the drawings, it will be seen that the cyclone separators attached to a riser outlet differ from conventional cyclones to provide an additional downwardly extending cylindrical section comprising a lower cyclone. In this arrangement, catalyst separated from gasiform material in the upper cyclone and sliding down the wall thereof is shaved off the wall by a downwardly sloping helical or annular baffle means separating the upper and lower cyclone. The catalyst collected by the helical baffle is contacted with tangentially introduced steam thereby substantially immediately further separating any entrained hydrocarbon product from the catalyst recovered from the upper cyclone. The stripping steam and stripped hydrocarbons are passed from the lower cyclone to the upper cyclone by a concentric open ended cylindrical pipe means in alignment with but spaced apart from the vapor outlet of the upper cyclone. Vortexing of the centrifugally stripped catalyst in the lower cyclone may be impeded by adding a vortex breaker in the lower catalyst collecting section of the combination cyclone separation unit. The catalyst collecting section is normally a conical section intermediate the cylindrical walls of the cyclone separator and the catalyst dipleg through which separated catalyst is withdrawn.

It will be observed from the sketch that a typical cyclone separator is modified by the extension of the cyclone catalyst collection hopper to include the specific catalyst collection and stripping means of the present invention thereby providing a second cyclonic separation arrangement below the upper or first cyclonic separation means. In the arrangement of FIG. I, a suspension of catalyst and reaction products such as products of catalytic cracking are introduced to the cyclone means by a conduit 2 which may be a rectangular or a circular conduit. The conduit 2 introduces the suspension tangentially to the cyclone cylindrical section 4 thereby causing a centrifugal separation of the solid catalyst particles from vaporous or gasiform reaction products. As mentioned above the separated solid particles slide down the cylindrical wall 4 for collection and/or stripping as herein discussed. Vaporous material separated from solids or catalyst particles enter the bottom open inlet of conduit 6 and are removed by passing upwardly through conduit 6 for recovery as more specifically discussed with respect to FIG. II.

The centrifugally separated solids sliding down the wall of the cyclone separator are caused to pass through annular section formed between a second open ended cylindrical pipe 8 of smaller diameter than the collection hopper wall 10 of the cyclone and coaxially positioned therein but spaced downwardly and apart from the bottom open end of conduit 6. A downwardly sloping annular baffle means 12 or helical baffle 12 connected between pipe 8 and wall 10 and completely circumscribing pipe 8 provides a vertical open 14 in one portion of the annulus through which the separated solids must flow into a second annular zone in contact with stripping steam introduced tangentially thereto by conduit 16. Conduit 16 also may be rectangular or circular for introducing the stripping steam tangentially to the cyclone beneath the baffle and catalyst inlet 12. The catalyst passing through opening 12 is contacted with steam introduced by conduit 16 and thereafter the mixture is separated by centrifugal action in the annular section below baffle 12 and between the lower portion of pipe 8 and cylindrical wall 18 of the cyclonic separator. The stripped and separated catalyst provided as above described then slides down the wall 18 and is collected in a conical hopper formed by wall 20. A catalyst dipleg 22 extends downwardly from the bottom of the conical section comprising wall 20. Stripped hydrocarbons and stripping gas, steam, separated from the catalyst pass upwardly through open end conduit 8 and into the bottom open end of conduit 6.

In the diagrammatic sketch of FIG. II, the strippercyclone of FIG. I is shown attached to the discharge end of a riser conversion zone 24 and housed in an enlarged vessel 26. The lower portion of vessel 26 and particularly comprising cylindrical section 28 is normally employed as a catalyst stripping section comprising baffles 32, 34, and 36. Stripping steam is introduced to the lower portion thereof by conduits 38 and 40. The level of catalyst retained in the stripping section may be as high as about line 42 but is normally retained as low as possible consistent with obtaining a desired stripping of the catalyst. Dipleg 22 may be extended lower into the vessel as the situation demands. Stripped catalyst is withdrawn from the stripping zone by conduit 44 for transfer to a catalyst regeneration zone to be presently described. A suspension of hydrocarbons and catalyst passes upwardly through riser 24 under desired selected cracking conditions usually at a temperature in excess of 900° F. and a hydrocarbon residence time with suspended catalyst less than about 15 seconds. The hydrocarbon residence time in riser 24 may be restricted to within the range of 2 to 8 seconds employing a reaction temperature of about 980° F. or more. The suspension in riser 24 passes adjacent the upper end thereof through an opening 2 into the stripper-cyclone arrangement shown and specifically discussed with respect to FIG. I. Separated vaporous materials comprising hydrocarbons and stripping gas pass upwardly through conduit 6 into an upper portion of vessel 26 or they may pass directly into a plenum chamber 46 from which they are withdrawn by conduit 48 for passage to product fractionator 60. When the vaporous material separated in cyclone 4 is discharged into the upper portion of vessel 26, it must then pass through cyclone 52 and conduit 54 into chamber 46.

Stripped products and stripping gas separated from the catalyst in stripping section 28 of vessel 26 pass through the bell mouth opening 50 of cyclone separator 52, wherein entrained catalyst fines are separated from the stripping gas before the gas passes through conduit 54 into plenum chamber 46. Separated catalyst fines are collected in hopper 56 and withdrawn therefrom by dipleg 58 for return to the catalyst bed 60 in the bottom portion of vessel 26.

The conversion products withdrawn from reactor 46 by line 48 are passed to main fractionator 59 for separation into desired products. The reaction products enter fractionator 59 at a "flash zone" in the lower part of the column in conventional manner. Distillation in fractionator 60 yields an overhead fraction constituted by gasoline and lighter, mostly gaseous, components passed by line 61 to condenser 62 and accumulator 63 from which gases lighter than gasoline are separated and transferred to the gas plant by line 64. A portion of the liquid separated in accumulator 63 is returned by line 65 as reflux to the top of fractionator 59 and the balance is transferred by line to storage or directly to blending and finishing operations for manufacture of motor fuel and related products. Distillate products heavy naphtha, light gas oil and heavy gas oil are taken as side draws at lines 67, 68 and 69, respectively, for transfer to storage or finishing steps as desired. A portion of the heavy gas oil may be recycled back to the reactor by blending with fresh feed from line 70, preheat with that fresh feed in furnace 71 and supply to the riser 24 in admixture with hot regenerated catalyst from standpipe 72. Valve 73 in standpipe 72 throttles flow of hot catalyst to provide that amount which will maintain a preset temperature at the top of riser 24 as detected by a suitable sensor, not shown. Also not shown is the conventional circuitry and motor drive by which valve 73 is caused to open or close responsive to the temperature detected by the sensor. Bottoms of fractionator 59 are withdrawn at 51. The bottoms contain catalyst fines not removed by the cyclones as a slurry in a very heavy oil constituted largely by polycyclic aromatic hydrocarbons. The catalyst fines are often removed by a clarifier, not shown, to yield a product designated "clarified slurry oil" or "CSO".

Stripped spent catalyst discharged by conduit 44 from reactor 26 is transferred by standpipe 74 through valve 75 to regenerator 76. Regenerator 76 may be of any of the several types used for that purpose and may be a simple fluidized bed, riser type, etc. In these several forms there are found regions of relatively high catalyst density followed, in the direction of air flow by regions of lesser catalyst density, particularly where catalyst is disengaged from regeneration fume. In a typical embodiment, the bulk of the catalyst in the regenerator is present a dense bed fluidized by air from pipe 77 through a distribution grid, not shown, in the lower part of regenerator 76. Spent catalyst from standpipe 74 is introduced to the dense bed tangentially and imparts a swirling movement thereof. Regeneration gases rising from the bed entrain a small amount of catalyst to produce the disperse phase mentioned above and enter cyclone separators, not shown, for removal of entrained catalyst which is then returned to the dense bed by conventional diplegs. Flue gas, substantially free of entrained catalyst, passes by line 78 to a boiler 79 where sensible heat of the flue gas is recovered for useful purposes by generation of steam. The spent flue gas is then transferred to a suitable stack by flue 80.

It has long been conventional to recover the fuel value of carbon monoxide in the regenerator effluent by burning that gas in the boiler 79, hence the common usage of the term "CO boiler" for this piece of equipment. In a large number of the FCC plants now in operation, top temperature of the regenerator is limited by metallurgical considerations to levels below that needed for ignition of CO burning. If dilute phase temperatures tend to approach the metallurgical limit, these are quenched by steam, water or the like. As a result, flue gas will reach the CO boiler at a temperature below the kindling point for CO and adequate temperature must be generated by introduction of air and supplemental fuel, as by the lines 81, 82.

The major problem arising from the installation of stripper cyclones in either new or existing units is that regenerator temperature is lowered due to removal of cracked product vapors entrained with the catalyst that would otherwise be burned in the regenerator. This lower regenerator temperature results in higher residual carbon on regenerated catalyst which reduces effective catalyst activity and offsets the product selectivity advantages obtained with the stripper cyclone. CO combustion enhances this operation by increasing regenerator temperature. Also, the problems of adapting existing commerical plants to take advantage of new developments, such as stripper cyclones for riser reactor FCC units, are complicated by design limitations which become severe "bottle-necks" under the new mode of operation inhibiting operation to take full advantage of the new technology. For example, in the case of an existing riser FCC unit presently to be discussed, it was found that application of stripper cyclone technology encountered bottlenecks from such factors as allowable temperature in the flash zone of the fractionator and volumetric capacity of the CO boiler. It is now found possible to mitigate these bottleneck effects by operating the regenerator in the CO burning mode.

Partial benefits of this type are achieved at partial CO burning characterized by a $CO_2/CO$ ratio in regenerator offgas above about 5 as compared with conventional levels below 2. In the preferred type of operation, substantially complete CO burning is accomplished, corresponding generally to CO concentration in the off gas of about 1000 parts per million (ppm) and less.

Those benefits are exemplified by reference to the commercial scale FCC riser reactor unit mentioned above in connection with bottlenecks. Actual data taken on the unit show the advantages to be derived by stripper cyclones stopping the cracking reaction at the top of the riser in reporting measured values on the effluent of the riser and on the effluent of the reactor after post-riser reaction of hydrocarbons remaining with the catalyst entering conventional strippers. The additional data reported below are derived by computer simulation of unit operation making the assumption that the observed post riser reaction will not occur when using stripper cyclones.

Table 1

| | Riser Outlet | Reactor Effluent | Δ Due to Post-Riser Cracking |
|---|---|---|---|
| Conversion, vol % | 75.4 | 78.1 | +2.7 |
| Gasoline, vol % | 61.7 | 61.5 | −0.2 |
| $C_4$'s, vol % | 13.7 | 15.3 | +1.6 |
| $C_3$'s, vol % | 9.3 | 10.6 | +1.3 |
| $C_2$ and Lighter, wt % | 1.9 | 2.6 | +0.7 |

A survey of the commercial unit with conventional internals, i.e., discharge from the primary cyclones at the top of the riser reactor into an enlarged space with a stripper section below and secondary cyclones above is considered to demonstrate the extent of post riser cracking. The survey examined samples from the riser outlet and from the effluent of the reactor. These data show considerable cracking of the hydrocarbon vapors after they leave the riser such as in the cyclone diplegs, in the top of the stripper and in the reactor vessel itself. The results of the survey and calculated effect of post riser cracking are shown in Table 1.

Efficient separation of hydrocarbons and catalyst by reactor stripper cyclones would terminate post riser cracking by terminating contact of hydrocarbons with the catalyst. In addition, the stripper cyclones should remove nearly all vaporizable hydrocarbons from the spent catalyst. Several stripper surveys on the commercial FCC unit discussed have indicated that, in conventional operation, unstripped vaporizable hydrocarbons represent about 7 to 10% of the total "coke" on catalyst transferred to the regenerator.

On the reasonable assumption stated above that reactor stripper cyclones will essentially eliminate post riser cracking and will reduce the regenerator fuel by stripping essentially all vaporizable hydrocarbons from catalyst transferred to the regenerator, calculations have been made to predict operation of this commercial FCC unit modified by installation of reactor stripper cyclones. The calculations were conducted by computer simulation of such operation with the aid of a mathematical model of FCC operation which has been found to correlate with actual operation within limits of acceptable deviation.

In applying the model, riser cracking and post riser cracking were treated as two distinct and successive cracking zones and tuning factors of the model were adjusted such that operation of the model matched a recent two month average of operations in the commercial unit. The second cracking zone (corresponding to post riser cracking) was then eliminated from the model and complete removal in reactor stripper cyclones of all vaporizable hydrocarbons was assumed. As so revised, the model was used to predict operation of the commercial unit after installation of reactor stripper cyclones. Data reported below are derived from such computer runs on the assumptions above stated.

The major advantage of using the model to simulate the effect of reactor stripper cyclones is that, in addition to simulating the product selectivity changes due to eliminating post riser cracking, the model also accounts for interactions with the unit heat balance (particularly from removing vaporizable hydrocarbons) which are not obvious from the survey reported in Table 1 above.

Among the constraints on the commercial unit being simulated are volumetric capacity of the CO boiler which restricts total volume per unit time of gases passed through the CO boiler. It will be seen below that this constraint limits the amount of air which can be introduced to the regenerator when significant amounts of CO are present in the regenerator effluent because a portion of the boiler capacity is necessarily allocated to fuel for maintenance of CO combustion temperature and supplemental air. That constraint due to capacity of the CO boiler limits the amount of air which can be introduced to the regenerator which limits severity of reaction in the reactor (limits gasoline yield) to the level which produces an amount of coke equal to that which can be burned by the maximum permissible air to the regenerator. Due to a main column flash zone temperature limit, riser top temperature is constrained to a maximum of about 960° F. These constraints must be and are observed in the calculations below of operation of the commercial unit. It will be seen that the constraints have profound effect on results which are attainable.

Table 2 compares yields with and without reactor cyclone stripper in the commercial unit. The "base case" represents actual operation during two recent months before installation of reactor stripper cyclones. Included in the bases for calculation are the assumptions of maximum air rate to the regenerator of 769,000 lb/hr, complete efficiency of the reactor stripper cyclone in removing vaporizable hydrocarbons and the like.

Of abbreviations in Table 2; "CFR" means "combined reed ratio" and refers to the ratio of total feed (including recycle of gas oil from the main column) to fresh feed; "CFT" is "combined feed temperature" to the riser; "$C_{reg}$" and "$C_{sp}$" refer to coke content of regenerated and spent catalyst, respectively.

Table 2

Effect of Reactor Stripper Cyclone

| | Base Case | | With Stripper Cyclones | |
|---|---|---|---|---|
| Cracking Conditions: | | | | |
| CFR, wt | 1.032 | | 1.032 | |
| CFT. °F. | 518 | | 518 | |
| Riser Top Temperature, °F. | 957 | | 957 | |
| Cat/Oil, wt | 6.21 | | 7.43 | |
| Regenerator Temperature, °F. | 1261 | | 1209 | |
| Creg, wt % | 0.19 | | 0.34 | |
| Csp, wt % | 0.88 | | 0.98 | |
| Unstripped Hyc, wt % | 8.7 | | 0 | |
| % $H_2$ on Coke | 8.8 | | 8.1 | |
| $CO_2$/CO mole Ratio | 1.88 | | 1.88 | |
| Air Rate to Reg., M lb/hr | 769 | | 762 | |
| Yields: | | | | |
| Conversion, vol % | 74.6 | | 71.9 | |
| | Wt. | Vol. | Wt. | Vol. |
| Clarified Slurry Oil | 4.9 | 4.0 | 4.9 | 4.1 |
| Heavy Fuel Oil | 1.4 | 1.2 | 2.7 | 2.3 |
| Light Fuel Oil (620° F. @90%) | 21.2 | 20.2 | 22.6 | 21.7 |
| $C_5$+ Gasoline (385° F., @90%) | 47.0 | 55.5 | 47.0 | 55.4 |
| Total $C_4$'s | 10.8 | 16.5 | 9.6 | 14.7 |
| Total $C_3$'s | 6.6 | 11.5 | 5.8 | 10.1 |
| $C_2$ and Lighter | 2.8 | | 2.1 | |
| Coke | 5.3 | | 5.3 | |
| | 100.0 | 108.9 | 100.0 | 108.3 |
| $nC_4$ | 1.2 | 1.8 | 0.9 | 1.4 |
| $iC_4$ | 4.7 | 7.4 | 4.2 | 6.7 |
| $C_4$= | 4.9 | 7.3 | 4.5 | 6.6 |
| $C_3$ | 1.9 | 3.4 | 1.5 | 2.6 |
| $C_3$= | 4.7 | 8.1 | 4.3 | 7.5 |

Feedstock properties used in the computer simulation represent an average of several samples obtained from the commercial unit. They are summarized in Table 3.

Table 3

Feedstock Properties Used in Computer Simulation of Effect of Stripper Cyclone

| Total Fresh Feed | | |
|---|---|---|
| Basic Nitrogen, wt % | 0.0227 | |
| API Gravity | 25.9 | |
| Couradson Carbon, wt % | 0.065 | |
| | 650° F. − Fraction | 650° F. + Fraction |
| Wt % FF | 30.6 | 69.4 |
| MW | 245 | 379 |
| Sulfur, wt % | 0.85 | 1.34 |
| Paraffins, wt % | 27.1 | 22.6 |
| Naphthenes, wt % | 39.6 | 34.5 |
| $C_A$, Wt % | 17.2 | 20.3 |

Typical equilibrium catalyst properties from the same unit are summarized in Table 4.

Table 4

Typical Equilibrium Catalyst Properties

| | |
|---|---|
| Surface area, $m^2$/gm | 94 |
| Pore volume, cc/gm | 0.32 |
| Bulk density, gm/cc | 0.86 |
| Ni, ppm | 220 |
| V, ppm | 620 |
| $Fe_2O_3$, wt % | 0.63 |
| $Na_2O$, wt % | 0.64 |
| Particle Size Distribution | wt % |
| 0–20 | 0.1 |
| 20–40 | 11 |
| 40–80 | 64 |
| 80+ | 25 |

The net effect of the reactor stripper cyclone is seen to be:

Table 5

| | Δ with Installation of Riser Stripper Cyclone at Constant CFT and Riser Top Temperature |
|---|---|
| Regenerator Temperature, °F. | −52 |
| Air Rate, M lb/hr | −7 |
| Conversion, vol | −2.7 |
| Gasoline, vol | −.1 |
| $C_4$'s, vol | −1.8 |
| $C_3$'s, vol | −1.4 |
| $C_2$ and lighter, wt | −.7 |
| Coke, wt | +.03 |

The major impact of the cyclones in this case is the large reduction in regenerator dense bed outlet temperature which is due primarily to the elimination of post-riser coke formation and the removal of all unstripped hydrocarbons currently carried to the regenerator. Furthermore, because of this decrease in regenerator temperature, carbon on regenerated catalyst increases substantially (from 0.19 to 0.34 wt %). This deactivates the catalyst and contributes to the drop in conversion. Another reason for the conversion decrease is the elimination of the incremental conversion that currently takes place beyond the riser outlet due to post riser cracking.

However, despite the lower conversion, gasoline yields are about the same with the stripper cyclones as without. This improvement in gasoline selectivity is due to the elimination of post-riser cracking which is characterized by very poor gasoline selectivity. Although in some FCC units, this conversion loss could be regained by raising riser top temperature or decreasing feed preheat temperature, the tight constraints on the commercial unit under discussion prevent any major increase in operating severity. (Catalyst activity is already near the optimum level.) Only a small decrease in feed preheat temperature is permissible. For example, Table 2 shows that, with no change in operating conditions, the stripper cyclones result in 7 M lb/hr decrease in regenerator air rate (from 769 to 762). Because of the large drop in regenerator temperature, flue gas leaves at a lower temperature and, therefore, less coke (i.e., lower air rate) is required to heat balance the unit. As shown in detail in Table 7 (Case 1), this allows feed preheat to be reduced slightly until the flue gas constraint corresponding to the 769 M lb/hr air in the base case is reached again. This minor optimization increases conversion and gasoline by only 0.2 and 0.1 vol %, respectively:

Table 6

| | Operation with Stripper Cyclones Conventional Regenerator Operation | | |
|---|---|---|---|
| | Current Operation Base Case (Table 2) | Same Conditions As Base (Table 2) | Minor Optimization (Table 7, Case 1) |
| Regen. Air Rate, M lb/hr | 769 | 762 | 769 |
| Feed Preheat Temp., °F. | 518 | 518 | 512 |
| Regenerator Temp., °F. | 1261 | 1209 | 1209 |
| Carbon on Regen. Cat., wt% | 0.19 | 0.34 | 0.34 |
| Conversion, vol % | 74.6 | 71.9 | 72.1 |
| Gasoline, vol % | 55.5 | 55.4 | 55.5 |

As CO combustion is increased, very significant changes occur in operation of the unit. The changes in $CO_2/CO$ ratio were accomplished by substituting for the catalyst of Table 2 an otherwise substantially similar catalyst containing 1 to 2 ppm of platinum and varying air rate to the regenerator to vary degree of CO combustion as reflected by $CO_2/CO$ ratio in regenerator off gases. The ratios reported of 7 and "greater than 150" correspond to CO contents of 1.9 vol % and less than 1000 ppm, respectively. The results, together with those of the minor optimization compared in Table 6 are set out in Table 7.

Cases 1, 2 and 3 of Table 7 are conducted at lowered preheat temperature of combined feed in order to match base case (1) with air rate limited to 769 M lb/hr. Case 4 takes advantage of the removal of constraint on regenerator air because no auxiliary air is required by the CO boiler.

Table 7

FCC Operation with Stripper Cyclones; Comparison of Conventional, Partial and Complete CO Combustion Regenerator Operation

| | Conventional CO Burning | | Partial CO Burning | | Complete CO Burning | | | |
|---|---|---|---|---|---|---|---|---|
| Case | (1) | | (2) | | (3) | | (4) | |
| $CO_2/CO$ Mole Ratio | 1.88 | | 7.0 | | 150 | | 150 | |
| Riser Top Temperature, °F. | 957 | | 957 | | 957 | | 957 | |
| CFT, °F. | 512 | | 474 | | 508 | | 400 | |
| Cat/Oil, wt | 7.50 | | 6.56 | | 5.75 | | 6.70 | |
| Regen. Temp., °F. | 1209 | | 1262 | | 1290 | | 1286 | |
| Creg, wt % | .34 | | .20 | | .08 | | .08 | |
| Csp, wt % | .98 | | .87 | | .78 | | .77 | |
| Mole % excess $O_2$ | 0.1 | | 0.1 | | 1.0 | | 1.0 | |
| Air Rate, M lb/hr | 769 | | 768 | | 769 | | 881 | |
| | Wt. | Vol. | Wt. | Vol. | Wt. | Vol. | Wt. | Vol. |
| Conversion | | 72.1 | | 73.2 | | 73.9 | | 76.6 |
| Clarified Slurry Oil | 4.9 | 4.1 | 5.0 | 4.1 | 4.9 | 4.0 | 5.0 | 4.0 |
| Heavy Fuel Oil | 2.6 2.2 | 2.0 | 1.7 | 1.7 | 1.5 | 0.4 | 0.3 | |
| Light Fuel Oil (620° F. @90%) | 22.5 | 21.6 | 21.9 | 21.0 | 21.6 | 20.6 | 20.2 | 19.1 |
| $C_5^+$ Gasoline (385° F.@90%) | 47.1 | 55.5 | 48.2 | 56.8 | 48.8 | 57.6 | 49.8 | 58.9 |
| Total $C_4$'s | 9.6 | 14.8 | 9.9 | 15.3 | 10.2 | 15.7 | 10.9 | 16.8 |
| Total $C_3$'s | 5.8 | 10.1 | 6.0 | 10.3 | 6.1 | 10.5 | 6.4 | 11.1 |
| $C_2$ and Lighter | 2.1 | | 2.1 | | 2.2 | | 2.2 | |
| Coke | 5.4 | | 4.9 | | 4.5 | | 5.1 | |
| Total | 100.0 | 108.3 | 100.0 | 109.2 | 100.0 | 109.9 | 100.0 | 110.2 |
| $nC_4$ | .9 | 1.4 | .9 | 1.4 | .9 | 1.4 | 1.0 | 1.6 |
| $iC_4$ | 4.2 | 6.8 | 4.3 | 6.9 | 4.4 | 7.0 | 4.8 | 7.7 |
| $C_4^=$ | 4.5 | 6.6 | 4.7 | 7.0 | 4.9 | 7.3 | 5.1 | 7.5 |
| $C_3$ | 1.5 | 2.6 | 1.5 | 2.6 | 1.5 | 2.6 | 1.6 | 2.8 |
| $C_3^=$ | 4.3 | 7.5 | 4.5 | 7.7 | 4.6 | 7.9 | 4.8 | 8.3 |

The low regenerator temperatures and high residual carbon level shown in conventional regenerator operation with the stripper cyclones suggest that there may be incentive to operate at high $CO_2/CO$ ratios which will clean up the catalyst and is shown in Table 7 to improve both conversion and gasoline selectivity.

Table 7 compares various optimized operations predicted for different CO combustion levels. As discussed in the previous section, Case (1) shows that in the conventional CO combustion mode, the stripper cyclone will maintain the same gasoline yield as current operation with a 2½ vol % decrease in conversion.

As shown in the summary table below, at a partial CO combustion level of 7 $CO_2/CO$ (Case 2) preheat level can be decreased to 474° F. without exceeding the air rate limitation.

| | Current Operation Base Case | Operation with Stripper Cyclones Partial CO Combustion (7 $CO_2/CO$) (Table 7, Case 2) |
|---|---|---|
| Regen, Air Rate, M lb/hr | 769 | 768 |
| Feed Preheat Temp., °F. | 518 | 474 |
| Regenerator Temp., °F. | 1261 | 1262 |
| Carbon on Regen. Catalyst, wt % | 0.19 | 0.20 |
| Conversion, vol % | 74.6 | 73.2 |
| Gasoline, vol % | 55.5 | 56.8 |

As CO combustion level goes up, each pound of coke liberates more heat as more burns into $CO_2$ rather than CO. Although each carbon atom burned to $CO_2$ requires twice as much oxygen as when burned to CO, more than twice as much heat is liberated. Consequently both less coke and less air are needed to maintain heat balance at a given set of conditions. This case shows that at partial CO burning, operation with the cyclone stripper results in a higher gasoline yield (=+1.3) but slightly lower conversion level than the base case.

An interesting comparison can be made between Case 2 and the base case (without stripper cyclone). Notice that both have essentially the same regenerator temperature and carbon levels on catalyst. This is because the heat balance is very similar in the two cases. With the addition of the stripper cyclone and partial CO combustion, we have essentially replaced one regenerator heat source, the entrained hydrocarbons, with another—i.e., increased burning to $CO_2$. Of course, the stripper cyclone can still show a definite gasoline yield advantage due to the elimination of post-riser cracking.

Although, as discussed above, operating the FCC with reactor stripper cyclones in a partial CO combustion mode does have advantages over the conventional mode, the unit is still constrained by a CO boiler flue gas limitation. As long as significant amounts of CO remain in the regenerator flue gas, the gas must be burned in the CO boiler. This requires considerable auxiliary fuel to be burned in the CO boiler in order to maintain adequate flame temperatures. The total flow rate of auxiliary fuel and air plus regenerator flue gas must not exceed the CO boiler throughput limit (about 1 MM lb/hr).

However, if CO is completely burned to $CO_2$ in the FCC regenerator, auxiliary fuel is no longer required in the CO boiler. This allows considerably more regenerator flue gas to be sent to the boiler, which would still be used as a waste heat boiler, before the throughput limitation is reached.

Cases 3 and 4, shown in Table 7 and summarized below, represent two complete CO combustion cases—one at the same regenerator air rate as current constrained operation (Case 3), and the other with the air rate increased considerably, but still below the CO boiler limit assuming no auxiliary fuel.

Table 8

| | Current Operation Base Case | Operation with Stripper Cyclones Complete CO Combustion: At Current Air Constraint (Case 3, Table 7) | Operation with Stripper Cyclones Complete CO Combustion: Unconstrained (Case 4, Table 7) |
|---|---|---|---|
| Regen. Air Rate, M lb/hr | 769 | 769 | 881 |
| Feed Preheat Temp., °F. | 518 | 508 | 400 |
| Regenerator Temp., °F. | 1261 | 1290 | 1286 |
| Carbon on Regen. Cat., wt % | 0.19 | 0.08 | 0.08 |
| Conversion, vol % | 74.6 | 73.9 | 76.6 |
| Gasoline, vol % | 55.5 | 57.6 | 58.9 |

In Case 3, because of the very low residual carbon on catalyst, gasoline selectivity has greatly improved (77.9% vs. 74.4% in base case). However, conversion is still lower than present operation with post-riser cracking. This case, however, can be improved since at full CO combustion since there is no need for auxiliary air to the CO boiler and the coke make restraint in the regenerator is relaxed. Case 4 shows that be decreasing feed preheat it is possible to increase conversion with the cyclone stripper and at the same time significantly improve gasoline selectivity. For example, at >150 $CO_2/CO$ ratio (CO at >1000 ppm) and 400° F. CFT, conversion increases 2.0 vol % and gasoline increases 3.4 vol % compared to the base case, thereby making this design modification extremely advantageous in conjunction with complete CO combustion.

Furthermore, despite the heat release from complete CO combustion, regenerator temperatures (dense bed outlet) are still below metallurgical limit of 1300° F. in the commercial unit.

These calculations are based on the assumption the stripper cyclones remove all unstripped hydrocarbons and eliminate all post-riser cracking. Stripper cyclones having efficiency performance significantly less than this would require reevaluation.

What we claim is:

1. In a process for catalytically converting hydrocarbons in the heat balanced FCC mode by suspending hot freshly regenerated catalyst in a stream of hydrocarbons to be converted, passing the suspension of hydrocarbons and catalyst upwardly through a riser conversion zone under elevated temperature conversion conditions, sensing the temperature at the top of said conversion zone, passing the suspension from the riser conversion zone directly into a cyclonic separation zone wherein a separation is made between catalyst particles and vaporous hydrocarbon products, passing the catalyst thus separated substantially immediately through an annular zone in contact with a stripping gas, passing stripping gas and stripped products separated from said catalyst in said annular zone upwardly through an open end restricted passageway in open communication with a passageway for removing separated hydrocarbon vapors from said cyclonic separation zone, subjecting catalyst so stripped to regeneration in a regeneration zone wherein the catalyst is contacted with air at elevated temperature to burn carbonaceous deposits therefrom whereby the catalytic activity is restored and the catalyst is heated by said burning, recycling the hot regenerated catalyst to said first stage for suspension in said stream of hydrocarbons, passing gaseous products of combustion from said regeneration to boiler means for recovery from said combustion products of heat values thereof, the capacity of said boiler means constituting a constraint on the volume of gaseous products of combustion which may be passed thereto from said regeneration and controlling the rate of recycling said hot regenerated catalyst responsive to the temperature sensed at the top of said conversion zone in a manner to maintain the temperature so sensed substantially constant:

the improvement which comprises conducting said regeneration under conditions to convert carbon monoxide in said regeneration zone including an amount of air adequate for so converting carbon monoxide and in contact with a sufficient amount of catalyst that a major portion of the heat generated by combustion of carbon monoxide is absorbed by said catalyst, said combustion of carbon monoxide being such that the gaseous products of combustion discharged from said regeneration zone has a ratio of carbon dioxide to carbon monoxide of at least 2 to 1.

2. A process according to claim 1 wherein said gaseous products of combustion contain less than 1000 ppm of carbon monoxide.

3. A process according to claim 1 wherein said catalyst is associated with a minor amount, below 10 ppm based on total catalyst, of platinum, palladium, iridium, rhodium, ruthenium, osmium or rhenium.

4. A process according to claim 1 wherein said catalyst is a zeolite cracking catalyst.

* * * * *

UNITED STATES PATENT AND TRADEMARK OFFICE

CERTIFICATE OF CORRECTION

PATENT NO. : 4,194,965

DATED : March 25, 1980

INVENTOR(S) : Ronald P. Billings and Ellen M. Hysell

It is certified that error appears in the above-identified patent and that said Letters Patent are hereby corrected as shown below:

Column 2, line 12 "catalystto" should be --catalyst to--.

Column 2, line 49 "ensible" should be --sensible--.

Column 2, line 66 "spaced" should be --space--.

Column 12 (Table 7) under "Heavy Fuel Oil", under Wt. "2.6 2.2" should be --2.6--, under Vol., "2.0" should be --2.2--, under Wt., "1.7" should be --2.0--, under Wt., "1.5" should be --1.7--, under Vol., "0.4" should be --1.5--, under Wt., "0.3" should be --0.4--, and under Vol. there should be inserted --0.3--.

Signed and Sealed this

*Fourth* Day of *November 1980*

[SEAL]

*Attest:*

SIDNEY A. DIAMOND

*Attesting Officer*

*Commissioner of Patents and Trademarks*